US006152363A

United States Patent [19]

Rule, Jr.

[11] Patent Number: 6,152,363

[45] Date of Patent: Nov. 28, 2000

[54] SLEEVE CONSTRUCTION FOR IMPROVED PAPERBOARD CUP INSULATION

[75] Inventor: James Arthur Rule, Jr., Lexington, Va.

[73] Assignee: Westvaco Corporation, New York, N.Y.

[21] Appl. No.: 09/303,759

[22] Filed: May 3, 1999

[51] Int. Cl.[7] ..... B65D 3/22

[52] U.S. Cl. ..... 229/403; 220/62.12; 220/592.17; 220/738

[58] Field of Search ..... 229/45, 400, 403; 220/62.12, 62.18, 592.17, 592.2, 592.23, 738, 739, FOR 157

[56] References Cited

U.S. PATENT DOCUMENTS

| | | | |
|---|---|---|---|
| Re. 35,830 | 6/1998 | Sadlier . | |
| D. 400,762 | 11/1998 | Mecklenburg . | |
| D. 401,122 | 11/1998 | Rench et al. . | |
| 2,617,549 | 11/1952 | Egger . | |
| 2,661,889 | 12/1953 | Phinney . | |
| 2,675,954 | 4/1954 | Vogel | 229/400 |
| 4,007,670 | 2/1977 | Albano et al. . | |
| 4,261,501 | 4/1981 | Watkins et al. . | |
| 4,435,344 | 3/1984 | Iioka . | |
| 4,548,349 | 10/1985 | Tunberg . | |
| 5,092,485 | 3/1992 | Lee . | |
| 5,145,107 | 9/1992 | Silver et al. . | |
| 5,203,490 | 4/1993 | Roe . | |
| 5,205,473 | 4/1993 | Coffin, Sr. . | |
| 5,209,367 | 5/1993 | Van Musscher et al. . | |
| 5,222,656 | 6/1993 | Carlson . | |
| 5,226,585 | 7/1993 | Varano . | |
| 5,259,529 | 11/1993 | Coale . | |
| 5,326,019 | 7/1994 | Wolff . | |
| 5,363,982 | 11/1994 | Sadlier . | |
| 5,385,260 | 1/1995 | Gatcomb . | |
| 5,425,497 | 6/1995 | Sorensen . | |
| 5,445,315 | 8/1995 | Shelby . | |
| 5,454,484 | 10/1995 | Chelossi . | |
| 5,460,323 | 10/1995 | Tituts . | |
| 5,490,631 | 2/1996 | Iioka et al. . | |
| 5,524,817 | 6/1996 | Meier et al. . | |
| 5,542,599 | 8/1996 | Sohol . | |
| 5,628,453 | 5/1997 | MacLaughlin . | |
| 5,660,326 | 8/1997 | Varano et al. . | |
| 5,667,135 | 9/1997 | Schaefer . | |
| 5,669,553 | 9/1997 | Smith . | |
| 5,697,550 | 12/1997 | Varano et al. . | |
| 5,713,512 | 2/1998 | Barrett . | |
| 5,746,372 | 5/1998 | Spence . | |
| 5,752,653 | 5/1998 | Razzaghi . | |
| 5,753,308 | 5/1998 | Andersen et al. . | |
| 5,759,624 | 6/1998 | Neale et al. . | |
| 5,766,709 | 6/1998 | Geddes et al. . | |
| 5,769,311 | 6/1998 | Morita et al. . | |
| 5,772,111 | 6/1998 | Kirsch . | |
| 5,775,577 | 7/1998 | Titus . | |
| 5,794,843 | 8/1998 | Sanchez . | |
| 5,820,016 | 10/1998 | Stropkay . | |
| 5,826,786 | 10/1998 | Dickert . | |
| 5,839,653 | 11/1998 | Zadravetz . | |
| 5,842,633 | 12/1998 | Nurse . | |
| 5,857,615 | 1/1999 | Rose . | |
| 6,068,182 | 5/2000 | Tokunaga | 229/403 |

FOREIGN PATENT DOCUMENTS

| | | | |
|---|---|---|---|
| 35-2076765 | 6/1977 | Japan | 229/403 |

*Primary Examiner*—Gary E. Elkins
*Attorney, Agent, or Firm*—J. R. McDaniel; R. L. Schmalz

[57] ABSTRACT

This invention relates to the construction of sleeves for use with paperboard cups. Such structures of this type, generally, employ a paperboard sleeve backed with hot-melt glue dots which are used to improve the insulating characteristics of a paperboard cup to the same level of common polystyrene cups.

5 Claims, 5 Drawing Sheets

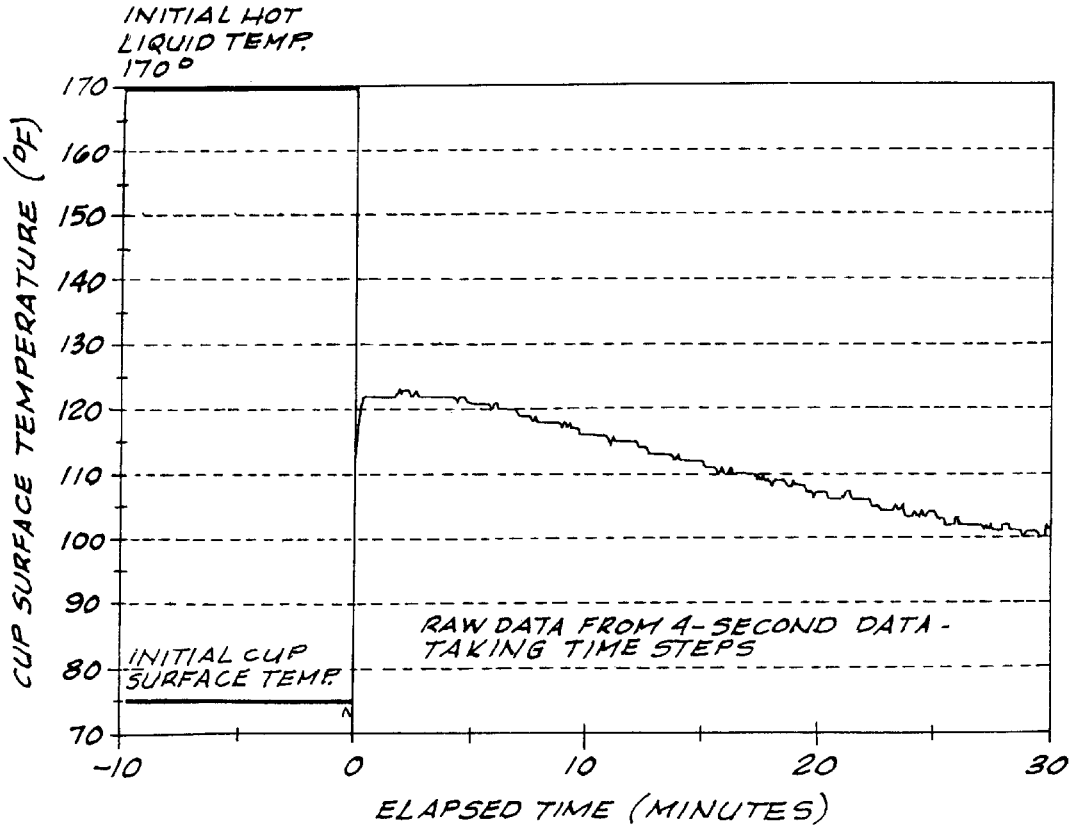
NYMAN CUP WITH 0.015 inch SLEEVE SURFACE TEMPERATURE
GRAPH 1

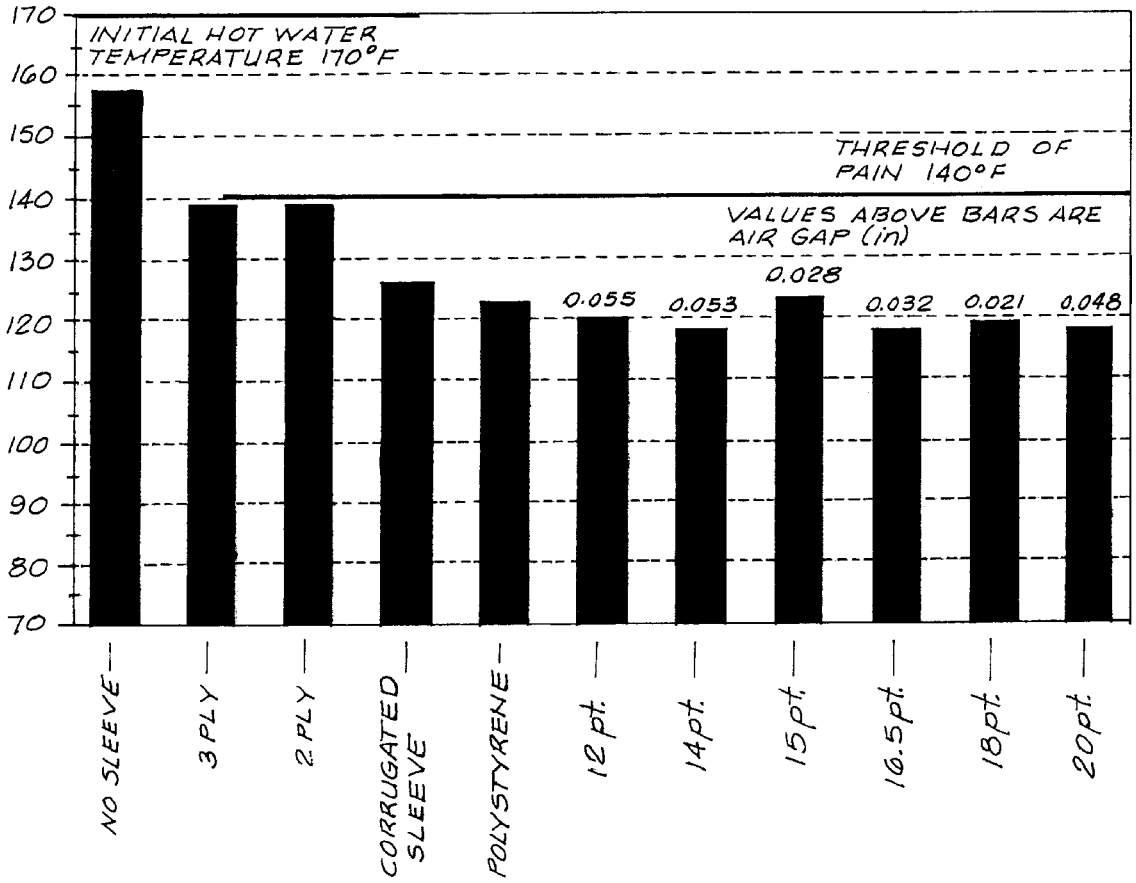
MAXIMUM CUP SURFACE TEMPERATURES FOR VARIOUS CUPS AND CONFIGURATIONS
GRAPH 2

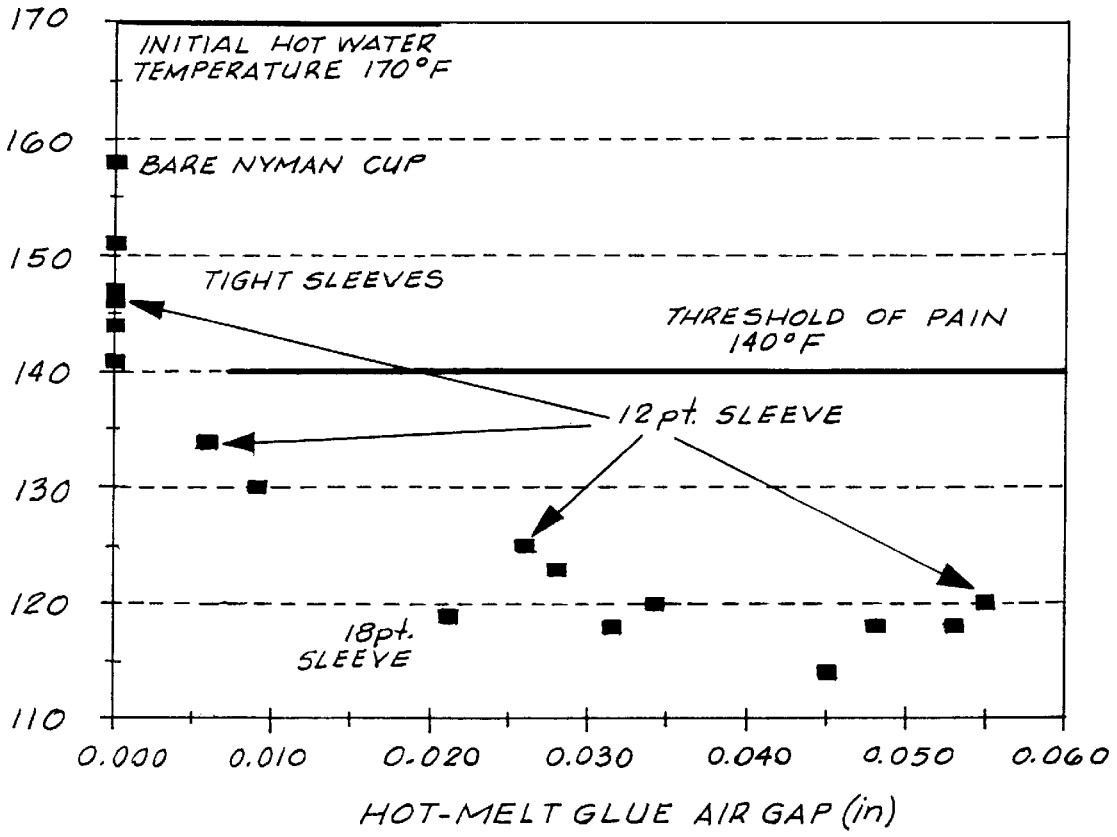
INFLUENCE OF AIR GAP ON SURFACE TEMPERATURE FOR VARIOUS BOARD CALIPERS
GRAPH 3

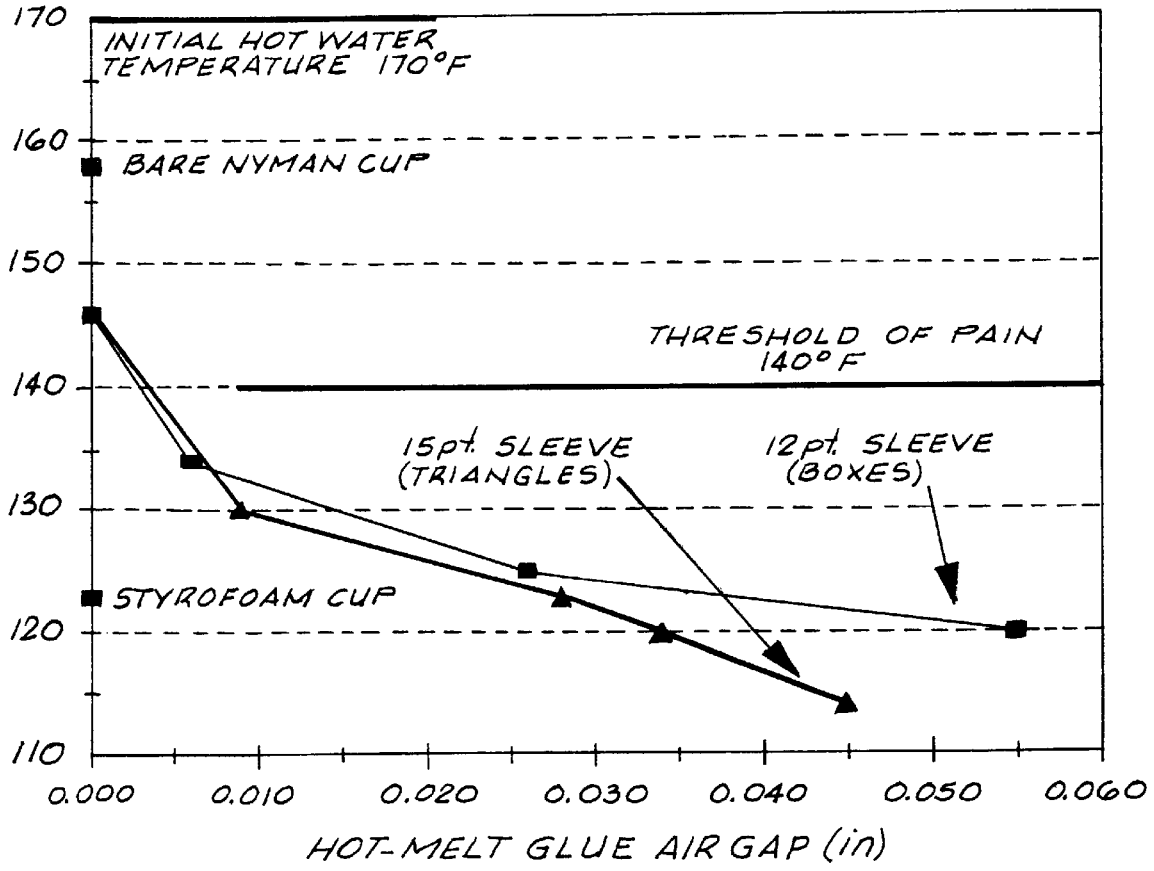
INFLUENCE OF AIR GAP ON SURFACE TEMPERATURE FOR 46# KRAFT BOARD
GRAPH 4

SLEEVE CONSTRUCTION FOR IMPROVED PAPERBOARD CUP INSULATION

BACKGROUND OF THE INVENTION

1. Field of the Invention

This invention relates to the construction of sleeves for use with paperboard cups. Such structures of this type, generally, employ a paperboard sleeve backed with hot-melt glue dots which are used to improve the insulating characteristics of a paperboard cup to the same level of common polystyrene cups.

2. Description of the Related Art

Common single-use coffee cups are primarily made of paperboard or polystyrene. It is well known that the thermal insulation characteristics of polystyrene cups are far superior to those of either kraft or bleached paperboard cups. When hot coffee is poured into a single-use cup, the cup surface temperature rises to a maximum in a few seconds, then slowly cools with the coffee back to ambient temperature. If the maximum cup surface temperature exceeds about 140° F., it is painful for an individual to hold the cup. The surface of a common polystyrene cup, nominally 0.090 in. thick, does not reach this threshold, but that of any single paperboard cup almost always exceeds it.

It is well known to employ various sleeve designs for cups which emphasize insulation capabilities. Exemplary of such sleeves are U.S. Pat. No. 5,205,473 ('473) to D. W. Coffin, Sr., entitled "Recyclable Corrugated Beverage Container and Holder," U.S. Pat. No. 5,425,497 ('497) to J. Sorensen, entitled "Cup Holder," U.S. Pat. No. 5,667,135 ('135) to R. J. Schaefer, entitled "Thermal Insulating Sleeve for Drink Cups," U.S. Pat. No. 5,746,372 ('372) to 0. Spence, entitled "Biodegradable Cup Holder," U.S. Pat. No. 5,794,843 ('843) to R. S. Sanchez, entitled "Cup Wrap," U.S. Pat. No. 5,826,786 ('786) to J. Dickert, entitled "Cup Holder Sleeve in Pre-Assembled Flat-Folded Form," and U.S. Pat. No. 5,842,633 ('633) to R. I. Nurse, entitled "Sleeve for Beverage Cups." While these references disclose various sleeves for use on beverage containers, none of these are particularly quantitative on the sleeve characteristics needed for good insulation.

It is also known to employ cup designs that emphasize insulation. Exemplary of such cup designs are U.S. Pat. No. 4,007,670 ('670) to J. V. Albano et al., entitled "Insulated Container," U.S. Pat. No. 4,261,501 ('501) to J. B. Watkins et al., entitled "Laminated Insulated Hot Drink Cup," U.S. Pat. No. 4,435,344 ('344) to A. Iioka, entitled "Method for Producing a Heat-Insulating Paper Container From a Paper Coated or Laminated With a Thermoplastic Synthetic Resin Film," U.S. Pat. No. 5,145,107 ('107) to V. K. Silver et al., entitled "Insulated Paper Cup," U.S. Pat. No. 5,226,585 ('585) to R. Varano, entitled "Disposable Biodegradable Insulated Container and Method for Making," U.S. Pat. No. 5,460,323 ('323) to J. H. Titus, entitled "Disposable Insulated Container," U.S. Pat. No. 5,542,599 ('599) to R. E. Sobol, entitled "Biodegradable Thermally Insulated Beverage Cup," U.S. Pat. No. 5,628,453 ('453) to D. M. MacLaughlin, entitled "Cup With Thermally Insulated Side Wall," U.S. Pat. No. 5,697,550 ('550) to R. Varano et al., entitled "Multi-Layered Insulated Cup Formed From Folded Sheet," U.S. Pat. No. 5,713,512 ('512) to R. K. Barrett, entitled "Polymeric Insulated Container," U.S. Pat. No. 5,752,653 ('653) to M. Razzaghi, entitled "Paper Cup With Air Insulation," U.S. Pat. No. 5,775,577 ('577) to J. H. Titus, entitled "Disposable Insulated Container With Microflute Structure," and U.S. Pat. No. 5,839,653 ('653) to R. B. Zadravetz, entitled "Container With Corrugated Wall." While a number of these references identify the effectiveness of an air gap and the providing of good insulation properties, they do not incorporate the simplicity of a sleeve cut from a single blank, add an air gap which is constructed of hot-melt glue dots, and employ a smooth outside-sleeve surface for printing.

It is apparent from the above that there exists a need in the art for a sleeve construction which is lightweight through simplicity of parts and uniqueness of structure, but which incorporates a sleeve cut from a single blank, adds an air-gap layer, and preserves a smooth outside-sleeve surface for printing. It is the purpose of this invention to fulfill this and other needs in the art in a manner more apparent to the skilled artisan once given the following disclosure.

SUMMARY OF THE INVENTION

Generally speaking, this invention fulfills these needs by providing a sleeve construction for providing insulation for a container, comprising a substantially smooth paperboard sleeve having a predetermined length and height and first and second sides, a plurality of air-gap means rigidly attached to the first side of the sleeve such that the air-gap means are individually spaced along the length, height, and first side of the sleeve in columns and rows, and a layer of printed graphics located substantially on the second side of the sleeve.

In certain preferred embodiments, the plurality of air-gap means includes hot-melt glue dots and/or pieces of syntactic foam.

In another further preferred embodiment, the paperboard sleeve backed with the plurality of air-gap means is used to improve the insulating characteristics of a paperboard cup to the same level of common polystyrene cups.

The preferred sleeve construction, according to this invention, offers the following advantages: lightness in weight; ease of assembly; good disability; good durability; excellent economy; excellent insulation characteristics; and an ability to be printed upon. In fact, in many of the preferred embodiments, these factors of lightness in weight, ease of assembly, excellent economy, excellent insulation, and an ability to be printed upon are optimized to an extent that is considerably higher than heretofore achieved in prior, known sleeve constructions.

A BRIEF DESCRIPTION OF THE DRAWINGS

The above and other features of the present invention, which will become more apparent as the description proceeds, are best understood by considering the following detailed description in conjunction with the accompanying drawings, wherein like characters represent like parts throughout the several views and in which:

FIG. 1 is a front view of a sleeve construction for providing insulation for a container, according to the present invention;

GRAPH 1 is a graphical illustration of cup surface temperature in ° F. versus elapsed time in minutes;

GRAPH 2 is a grahical illustration of cup surface temperature in ° F. versus cup and sleeve configuration;

GRAPH 3 is a graphical illustration of cup surface temperature in ° F. versus air gap in inches; and GRAPH 4 is a graphical illustration of cup surface temperature in ° F. versus Air gap in inches.

DETAILED DESCRIPTION OF THE INVENTION

Figure 1:
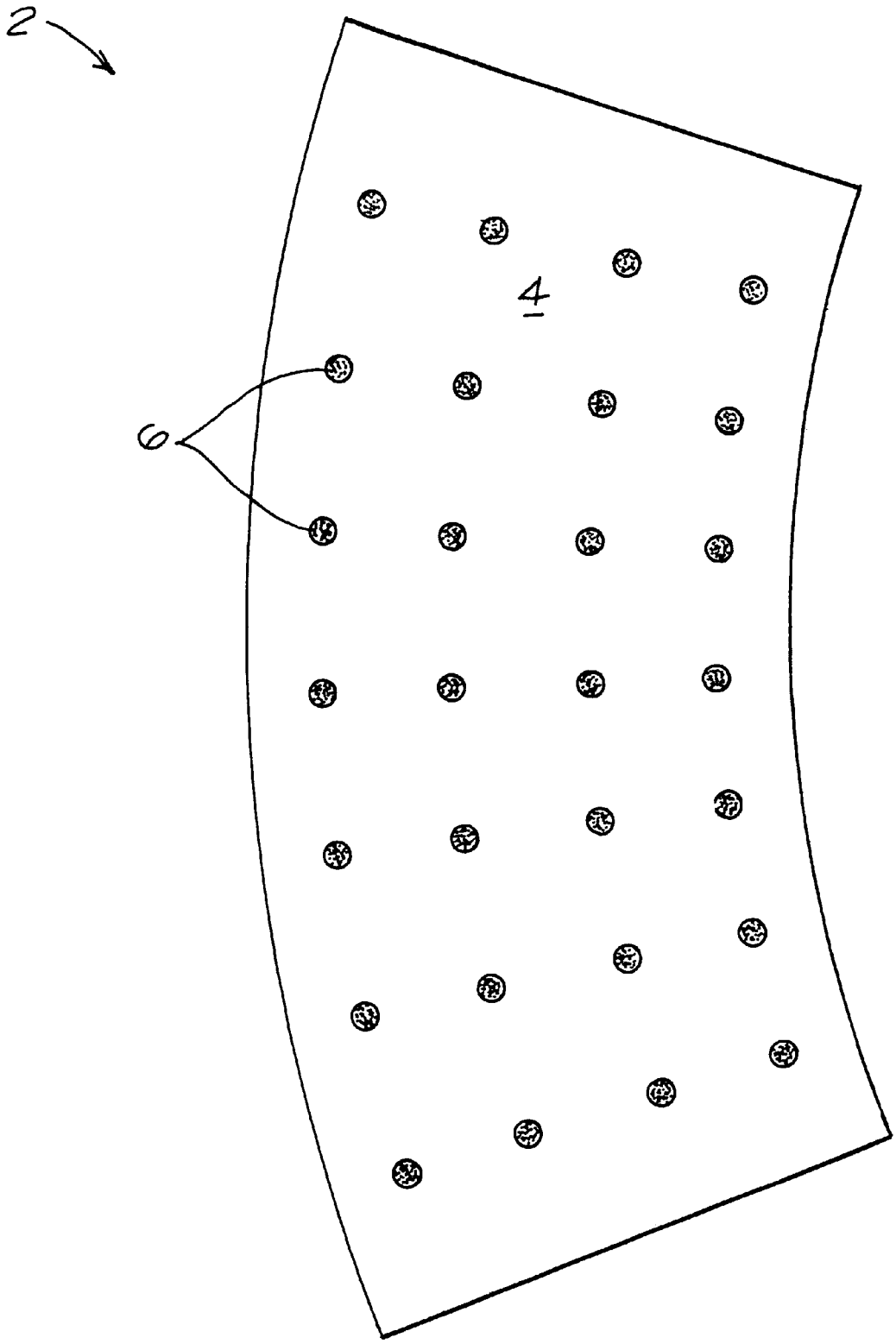

Heat transfer is the mechanism of transferring energy across a system boundary from a system of higher temperature to one of lower temperature. When holding a hot cup of coffee, the hot liquid represents the hot system, the cup represents the system boundary and heat transfer interface, and your fingers and the surroundings represent the lower temperature system.

Heat is conducted into your fingers while you hold the cup. The rest of the heat flows by convection to the surroundings. Fourier's law of conduction describes the rate at which heat is transferred across the system boundary and is given below in Equation 1:

$$q = -kA\left(\frac{dT}{dx}\right) \quad \text{(Eq. 1)}$$

where:

q is the rate at which heat is transferred in Btu/hr,

A is the cross-sectional area of the heat transfer interface in $ft^2$, dT/dx is the temperature gradient across the heat transfer interface in ° F./ft, and k is the thermal conductivity in Btu/(hr ft ° F.).

The electrical analogy is a tool for analyzing one-dimensional conduction, and combined conduction/convection problems. The electrical analogy is given below in Equation 2:

$$\text{Heat Flow} = \frac{\text{Thermal Potential}}{\text{Thermal Resistance}} \quad \text{(Eq. 2)}$$

Schematically, the analogy can be described by:

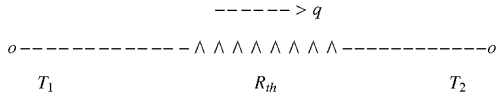

and the electrical analogy would be as shown below in Equation 3:

$$q = \frac{(T_1 T_2)}{R_{th}} \quad \text{(Eq. 3)}$$

The combination of thermal conductivity, thickness of the insulating material, and interface area combine to create resistance to heat flow.

A popular way to describe the performance of insulating materials for buildings is the R-value. The larger the R-value, the better the insulating value. The R-value is defined below in Equation 4 is:

$$R\text{-value} = \frac{\Delta x}{k} \quad \text{(Eq. 4)}$$

where:

Δx is the material's thickness, ft, and k is the thermal conductivity, (Btu/hr ft ° F.).

For high insulating ability, one wants a thick material with a low thermal conductivity. Values of thermal conductivity for paperboard and other materials and the relationship to insulation performance are well known.

If one extends the electrical analogy to include convection heat transfer from the cup surface to the surroundings the series circuit becomes:

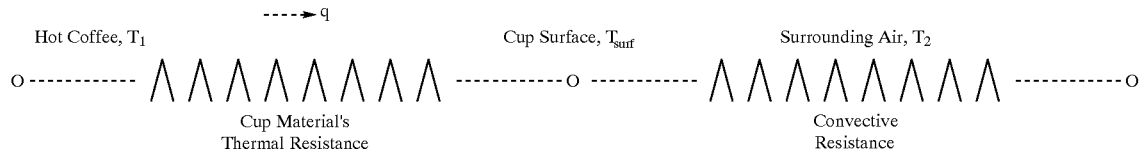

Coffee drinkers are not particularly interested in the thermal conductivity or caliper of the cup. Their main concern is the surface temperature, $T_{surf}$. 140° F. is commonly used as a pain threshold for hot surface insulation guidelines. This guideline appears to be consistent with observed behavior.

The purpose of the basic experiment is to quantify the surface temperature of candidate coffee cups and sleeve configurations through their useful lives. A measured, 6.7 oz. (200 ml) container of water is heated in a microwave to over 170° F., usually to the boiling point. The water temperature is monitored by a conventional thermocouple probe until it cools to 170° F. The water is quickly poured into the candidate coffee cup.

A conventional infrared temperature gun is positioned 24 in. away from the cup surface, about at the middle of the cup. This position corresponds to a 0.9 in. diameter target. The instrument measures infrared radiation to infer the surface temperature. An emissivity of 0.95 was used for all tests. The infrared gun's interface is connected to a conventional computer and conventional software is used to record the surface temperature on 4 sec intervals for approximately 30 minutes.

Six different grades of cup stock with calipers or thicknesses ranging from 12 pt to 20 pt were tested. 12 pt corresponds to a thickness of 0.012 inches. Cup sleeves backed with hot-melt glue dots were fabricated from these samples. A template for the sleeve, including a plurality hot-melt glue dots arranged in columns and rows, is shown in FIG. 1. It is to be understood that dots of syntactic foam could be used instead of the glue dots.

At first, little attention was paid to the size of the hot-melt dots, simply trying to keep them at a uniform size for all the samples. Later it was recognized that the size of the dots had an effect on the maximum cup surface temperature, so experiments were run with a range of dot sizes on cup stock grades of a basis weight of 46 pounds/1000 $ft^2$ (46#) and a thickness of 0.015 and 0.012 inches (15 and 12 pt, respectively). All these experiments were compared to those of a commercial polystyrene cup, a three-ply paperboard cup, a two-ply paperboard cup, a single Nyman kraft cup manufactured by Nyman Corp. of E. Providence, Rhode Island, and a Nyman cup fitted with a conventional corrugated sleeve.

An example of the surface temperature test is shown in Graph 1 for a single Nyman cup fitted with a 15 pt 46# paperboard sleeve, constructed according to the present invention. The maximum surface temperature occurs a few seconds after pouring the hot water into the cup. In this case the maximum temperature was 123° F., about the same as a commercial polystyrene cup, both being significantly below the 140° F. threshold of pain. The classical first-order temperature decay can be observed following the initial condition.

The additional candidate cups and configurations were studied. The maximum surface temperatures achieved by all the configurations and the range of sleeves are shown in Graph 2. All of the Nyman cups fitted with hot-melt glue dot sleeves either met or slightly exceeded the thermal performance of the polystyrene cup. The multi-layer cups achieved maximum surface temperature below the 140° F. threshold of pain, but did not approach the thermal performance of the polystyrene benchmark.

The air gap created by the hot-melt dots was determined by subtraction once the sleeve was fixed onto the Nyman cup. The total cup/sleeve thickness was caliper-measured between two neighboring glue dots, so the air gap reported is about 0.015 in. less than the maximum height of a glue dot. Nonetheless, the measurement was made in a repeatable manner. The maximum cup surface temperatures are plotted as a function of the air gap for all the sleeves tested, regardless of grade, in Graph 3.

The dependence of temperature on the air gap becomes readily apparent. For this reason, we went back and performed repetitive tests on 15 pt 46# and 12 pt 46# cup stock for a range of glue dot sizes. Performance of sleeves using these two grades with variable air gap thicknesses is depicted in Graph 4. The 15 pt sleeve thermally outperformed the 12 pt cup stock sleeve by a slight amount. Comparing the maximum surface temperature for these sleeves to the polystyrene cup, a glue dot air gap of 0.030–0.040 in. is sufficient for the Nyman cup and kraft sleeve to meet or exceed the thermal resistance of the polystyrene cup.

Once given the above disclosure, many other features, modifications or improvements will become apparent to the skilled artisan. Such features, modifications or improvements are therefore, considered to be a part of this invention, the scope of which is to be determined by the following claims.

What is claimed is:

1. A sleeve construction for providing insulation for a container, wherein said sleeve construction is comprised of:

a substantially smooth paperboard sleeve having a predetermined length and height and first and second sides;

a plurality of air gaps rigidly attached to said first side of said sleeve such that said air gaps are individually spaced along said length, height, and first side of said sleeve in columns and rows; and a layer of printed graphics located substantially on said second side of said sleeve.

2. The sleeve construction, as in claim 1, wherein said paperboard sleeve is further comprised of:

paperboard having a caliper of approximately 0.015 inches and a basis weight of 46 pounds per 100 $ft^2$.

3. The sleeve construction, as in claim 1, wherein said air gaps are further comprised of:

dots of hot-melt adhesive.

4. The sleeve construction, as in claim 1, wherein said air gaps are further comprised of:

dots of syntactic foam.

5. The sleeve construction, as in claim 1, wherein said air gaps create an air gap range between said sleeve and a container of approximately 0.030–0.040 inches.

* * * * *